United States Patent [19]

Moritz

[11] Patent Number: 4,639,282

[45] Date of Patent: Jan. 27, 1987

[54] INSULATION OF METALLIC SURFACES IN POWER TRANSFORMERS

[75] Inventor: Bertil Moritz, Ludvika, Sweden

[73] Assignee: ASEA Aktiebolag, Västerås, Sweden

[21] Appl. No.: 829,953

[22] Filed: Feb. 18, 1986

[30] Foreign Application Priority Data

Feb. 19, 1985 Sweden .....8500780

[51] Int. Cl.[4] ..... H01B 13/26

[52] U.S. Cl. ..... 156/53; 156/56; 336/84 R

[58] Field of Search ..... 29/602 R, 605; 156/53, 156/56; 174/35 R, 35 MS, 36; 307/91; 336/84 R, 84 C, 84 M; 428/365

[56] References Cited

U.S. PATENT DOCUMENTS

| | | | |
|---|---|---|---|
| 3,173,116 | 3/1965 | Schneider | 336/84 R |
| 3,327,268 | 6/1967 | Rabus | 336/84 C |
| 3,376,531 | 4/1968 | Fischer et al. | 336/84 C X |
| 3,531,751 | 9/1970 | Sargent | 156/56 X |
| 3,928,832 | 12/1975 | Forsberg et al. | 336/84 R X |
| 3,959,549 | 5/1976 | Penczynski et al. | 156/53 X |
| 4,449,111 | 5/1984 | Nakajima | 336/84 C X |

OTHER PUBLICATIONS

Uhlmann, *Power Transmission by Direct Current*, Springer Verlag, 1975, Cat. No. TK 3111.u37.

*Primary Examiner*—Robert A. Dawson

*Attorney, Agent, or Firm*—Watson, Cole, Grindle & Watson

[57] ABSTRACT

A method for improving the electrical insulation of an electrode in a power transformer included in a converter plant of a high voltage direct current (HVDC) transmission system. The method involves winding around the electrode, layers of tape of woven or non-woven fibrous structure of non-conducting cellulose material, inorganic plastics material, or inorganic insulating material. This means that ions approaching the electrode, which are migrating under the influence of a high d.c. field outside the electrodes, do not sense the porous tape insulation as any noticeable obstacle, while at the same time the insulating layer is sufficiently dense to increase the breakdown value in the case of electrical surges.

14 Claims, 5 Drawing Figures

INSULATION OF METALLIC SURFACES IN POWER TRANSFORMERS

TECHNICAL FIELD

This invention relates to a method for the electrical insulation of a metallic surface immersed in an electrically insulating liquid medium in a transformer which is subjected to a high voltage direct current, HVDC. The metallic surface may be an electrode, or other electrically energized metallic body of the transformer, but also metallic surfaces and bodies at ground potential. Thus the invention embraces the protection of, inter alia, busbars, conductors from widings, bushing or lead conductors leading to the terminals of a transformer, electrostatic shields, and so on and for convenience these will be referred to herein as "electrodes".

In a transformer to which this invention relates, the transformer core windings and internal connections are immersed in a transformer tank which is filled with a liquid insulating medium, normally a so-called transformer oil. Via openings in the transformer tank, the winding and lead conductors connect the transformer windings to the terminals of the transformer. These conductors are normally each surrounded by a bushing turret which supports the conductors and the terminals. The bushing turrets communicate with and are also filled with the same liquid insulating medium as the transformer tank. An electrostatic shield is normally provided in the bushing turret at the transition between the winding conductor and the lead conductor, to avoid excessive electrical field gradients developing at the transition.

In addition to being insulated by the liquid medium, the electrodes are provided with additional insulation in the form of a non-conducting layer of cellulose material (e.g. paper or pressboard), organic plastics material (e.g. a film or varnish layer), or an inorganic insulating material (e.g. an enamel layer).

Technical Problem to be Solved

Before describing the state of the art with regard to this additional insulation, a short account of the special conditions which apply to the insulation methods employed in power transformers in converter plants, and the problems which arise in this connection, will first be given.

In an HVDC plant there is often used at least one converter bridge for each pole and station. A plurality of bridges are commonly series-connected, one of the poles of a first bridge being connected to ground, and the other pole being connected to the next bridge so as to achieve the series connection. In this way, the d.c. voltage potential of each bridge, relative to ground potential, increases with the number of bridges that are series-connected.

Each bridge in the series connection is supplied with a.c. voltage from an individual transformer. With increasing d.c. voltage potential on the bridges relative to ground potential, the insulation of the windings of the transformers which supply the bridges will be subjected to an increasingly higher d.c. voltage potential with a superimposed a.c. voltage. The insulation of these transformer windings must therefore be dimensioned so that it is capable of withstanding the increasingly higher insulation stresses to which it is subjected.

The increasing d.c. potential leads to special problems which do not exist in ordinary transformers. This is due to the fact that the insulating media that are used, the liquid medium, the cellulose material, etc.—although being excellent insulators—do transmit electric current to a certain, minor extent. The charges that transport the current in the liquid insulating medium are considered to be ions from impurities present in the medium. These impurities are disassociated, that is, decomposed and form ions with positive and negative charges, respectively. In the case of a continuously applied d.c. voltage, the positively charged ions migrate towards a negative pole, and the negatively charged ions migrate towards a positive pole. Thus, the different kinds of ions migrate in opposite directions in the electrical field. Now, if one kind of ion is not able to penetrate an electrode coating or barrier in its path, the ions of this ion type accumulate immediately outside this barrier, which results in an increase in the electrical field across the barrier. Concurrently with the increased electrical field, the ion current through the barrier also increases until an equilibrium has been reached when the ion current flowing towards the barrier is equal to the ion current flowing through the barrier. When this occurs, the coating/barrier is polarized to the greatest possible extent, that is, it has the greatest voltage difference in relation to the electrode metal that it can have under the prevailing circumstances. In that event, a considerable part of the total d.c. voltage, to which the transformer is subjected, may appear across the coating/barrier. Now, if this coating/barrier does not have sufficient insulating properties to withstand this highest voltage difference, an electrical breakdown will occur even during the build-up of the voltage difference. If such a breakdown does occur, the entire insulating device is generally destroyed.

DISCUSSION OF PRIOR ART

The simplest way of preventing the build-up of the above-mentioned barrier potential would be not to have any barrier at all, that is, to use unshielded, uninsulated electrodes. This would function quite satisfactorily if the electrodes were subjected only to d.c. voltage. Since the region nearest the electrodes also has to withstand an a.c. voltage and, in an HVDC converter plant, stresses which are associated with surge voltages arising in the a.c. network, having unshielded electrodes is in fact not a practical solution, since experience indicates that the voltage at which breakdown would occur would then be greatly reduced.

According to the prior art, therefore, the electrodes in question are provided with such thick insulating coatings that the coating/barrier is able to withstand the maximum voltages that may occur without the risk of insulation breakdown. To cope with this, coatings of cellulose material of a thickness of several centimeters are often needed. Examples of the prior art in this respect are to be found, inter alia, in the book *Power transmission by direct current* by E. Uhlmann, Springer Verlag 1975, (see, for example, FIG. 18.4).

One disadvantage of the above-mentioned insulating layers is that they efficiently prevent the removal of heat from heat-generating electrodes, such as, for example, busbars. Insulating layers of a varnish type may, in the event of careless handling, be subjected to scratches which are very undesirable from the insulation point of view, since insulation breakdowns are often concentrated in such regions.

Studies of insulation breakdowns caused by a.c. voltage stress have been carried out using high-speed photography and are described, for example, by U. Gäfvert in "Particle and oil motion close to electrode surfaces" in Proc. CEIDP Amtrust Mass., USA, October 1982. The studies have shown that immediately prior to a breakdown, the emission of ions from discrete locations in the liquid medium is particularly great. The ion emission manifests itself in the form of a visible turbulence in the medium adjacent to discrete locations of the electrode, and this turbulence can be demonstrated photographically.

SUMMARY OF THE INVENTION

The present invention aims to overcome the above-mentioned problems and the partially contradictory demands for insulation. It comprises using an electrode insulation of such porosity that ions approaching the coating/barrier of the electrode do not sense the presence of the insulation as a significant obstacle, while at the same time the coating/barrier is sufficiently dense to prevent the initiation of a breakdown when an a.c. voltage stress occurs. Tests have shown that a coating/barrier of the required properties can be realized by using a few layers of a wrapping material (e.g. a fabric or (non-woven) felt), each layer having pores of an open area in the range 0.2 to 10 $mm^2$ and with an aggregate pore area which is from 20% to 80% of the total area of the wrapping material. Woven or non-woven materials made of cotton, glass fibers, wood cellulose fibers (e.g. paper) or plastics fibers are particularly suitable.

Thus, by employing the method according to the invention, it is possible to obtain (a) passage of ions through the insulating layer, whereby no significant d.c. voltage difference can develop across the layer, (b) sufficient insulation strength against the expected a.c. voltage and (c) better heat-removing properties than in the case of the thick lining of cellulose material previously used. Also, the porous coatings employed in the method of the invention are not as sensitive to careless treatment which, for example in the case of prior art varnish insulations, may cause scratches and the like.

BRIEF DESCRIPTION OF THE DRAWINGS

The invention will now be described, by way of example, with reference to the accompanying schematic drawings, in which.

DESCRIPTION OF PREFERRED EMBODIMENT

An embodiment in which a method according to the invention is used in the insulation of the above-mentioned electrostatic shield will now be described in greater detail.

Figure 1:
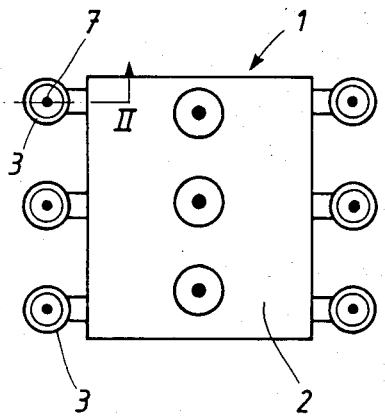
FIG. 1 is a plan of a transformer included in a converter plant for transmission of high voltage direct current.
Figure 2:
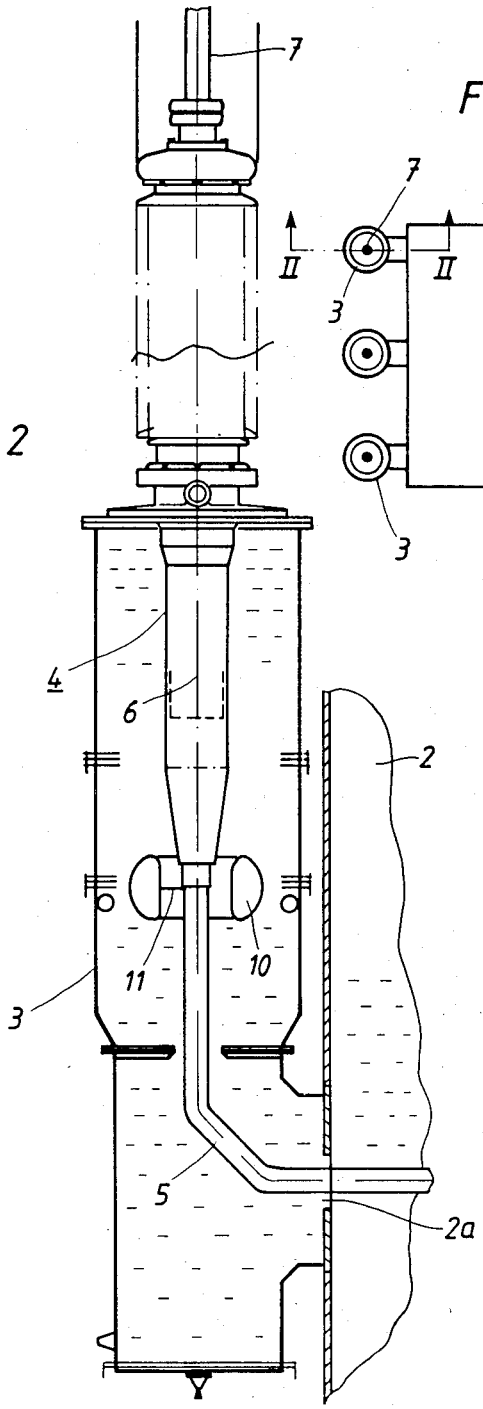
FIG. 2 is a partial vertical section taken along line II—II in FIG. 1.

In FIG. 1, 1 designates a three-phase transformer comprising an oil-filled transformer tank 2 with a transformer core (not shown) arranged therein with a primary winding and secondary windings. From the transformer tank 2 there extend a plurality of bushing caps 3, each of which supports a bushing 4 as shown in FIG. 2. Each cap 3 is completely oil-filled and communicates with the transformer tank 2 via an opening 2*a* in the transformer tank 2.

As shown in FIG. 2, a winding conductor 5 passes into the bushing cap 3, the upper end of the conductor 5 being electrically connected to the lower end of the bushing 4. The upper end of the bushing 4 is connected to a vertically extending lead conductor 7.

Figure 3:
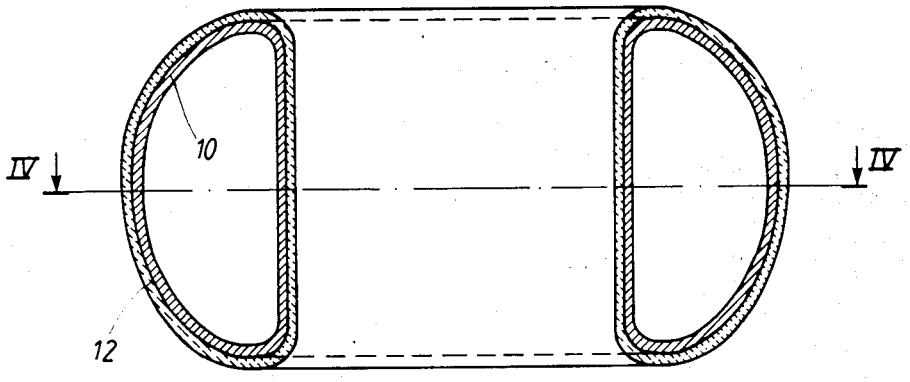
FIG. 3 shows, in vertical section taken along line III—III in FIG. 4, and on an enlarged scale, a shielding body also shown in FIG. 2.
Figure 4:
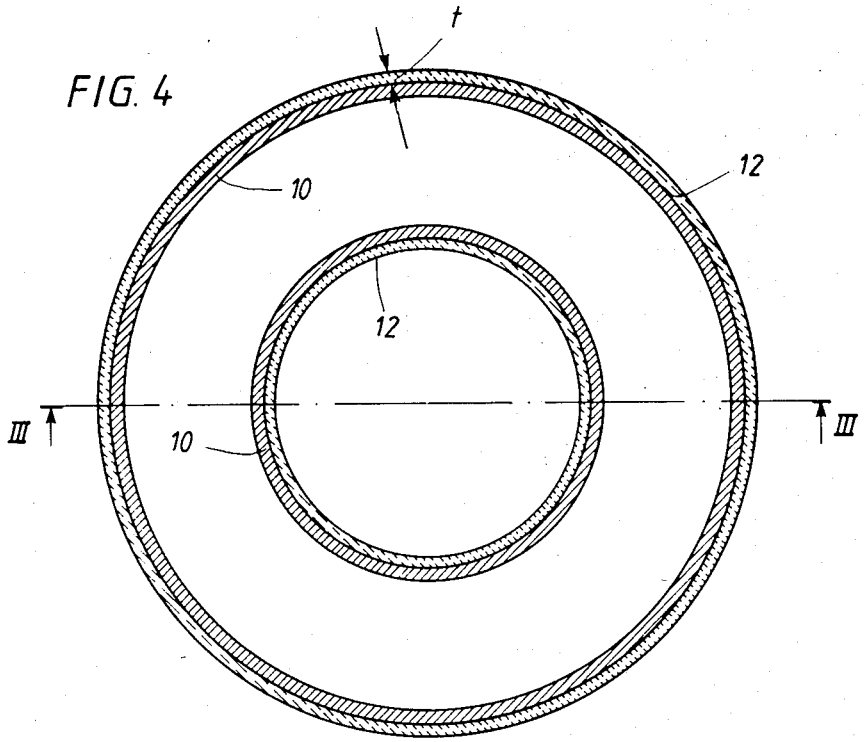
FIG. 4 shows the shielding body of FIG. 3 in horizontal section taken along the line IV—IV in FIG. 3.

An electrostatic shield in the form of a metallic, annular shielding body 10 surrounds the point of connection of the conductor 5 to the lower end portion of the bushing 4. The shielding body 10 is electrically and mechanically connected to the conductor 5 by means of a connection means shown at 11 in FIG. 2. The shielding body 10 is shaped as a body of revolution, the axis of rotation of which substantially coincides with the axis 6 of the bushing 4. As shown in FIGS. 3 and 4, the shielding body 10 is formed as a hollow ring, although alternatively it may be solid. At least a major part of the external surface of the shielding body 10, and typically the entire external surface thereof, is provided with an electrically insulating coating 12 according to the invention. The coating 12 consists of at least three, and preferably from eight to thirty, layers—arranged one upon the other—of a thin flexible and porous material. The material can be a knitted or woven fabric or a non-woven felt-like material, such as porous paper. The coating 12 can be made of basic materials such as cotton, glass fibers, wood or other cellulose fibers or plastics fibers.

Figure 5:
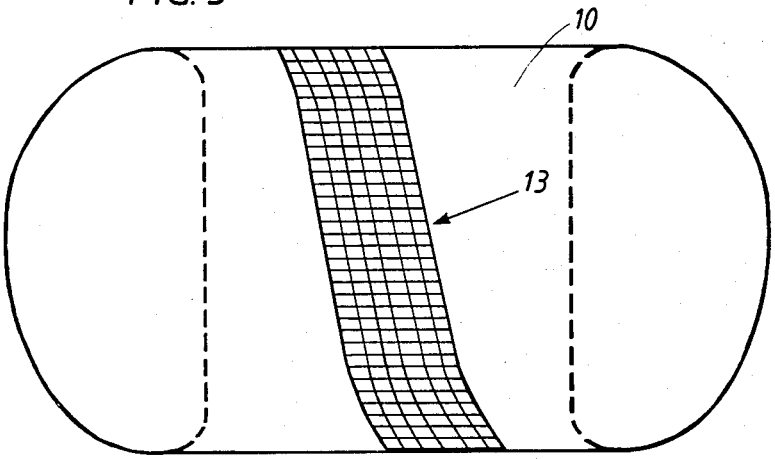
FIG. 5 is a schematic side elevation of the shielding body of FIGS. 3 and 4, showing a stage in the manufacture therefor.

FIG. 5 shows the shielding body 10 during a manufacturing stage according to the invention, when spiral winding with a tape 13 of a thin flexible woven fabric has just commenced. Preferably, each winding turn overlaps a previously laid turn. As will be clear from the comments above, the tape 13 may have a woven structure, as shown in FIG. 5, or it may have a felt structure such as porous paper, provided it has adequate permeability to the ion current.

Instead of forming coating 12 by wrapping with a tape-formed material, the coating can be formed using a sheet-formed material which, depending on the dimensions of the sheet, can either be wrapped directly around the body 10 or can first be cut to suitable dimensions to facilitate such wrapping.

In order to attain the required technical effect, it is important for the wrapping material to have adequate porosity. The pores should preferably each have an open area of 0.2–10 $mm^2$ and the aggregate area of the pores should preferably constitute from 20 to 80% of the total area of the wrapping material. In dependence on the selected pore size in the individual tape, however, a sufficient number of layers of tape should be wrapped one upon another that the metal surface is no longer visible through the pores.

The average thickness of the insulating coating 12 (i.e. the dimension "t" in FIG. 4) is preferably in the range of from 1 to 5 mm.

As will be clear from the foregoing, the object of a method according to the invention is to coat any metallic surface in a power transformer which might occasion the build-up of a barrier potential—with an electrically insulating coating, consisting of tape of the type and material mentioned, around the respective electrodes.

Many modifications can be made to the details of the construction described with reference to the drawings and all such modifications which are included within the scope and spirit of the following claims are to be considered as forming part of this invention.

I claim:

1. A method for electrically insulating a metallic surface immersed in an electrically insulating liquid medium which is subjected to a high d.c. voltage, which method comprises covering the metallic surface with an electrically insulating layer comprising at least three layers of a wrapping material having a fibrous and porous structure, the individual layers having throughgoing pores or openings with an opening area in the range 0.2–10 $mm^2$ and with an aggregate pore area which is from 20 to 80% of the total area of the wrapping material.

2. A method according to claim 1, in which a woven wrapping material is used.

3. A method according to claim 1, in which a nonwoven wrapping material is used.

4. A method according to claim 3, in which a porous paper is used as the wrapping material.

5. A method according to claim 1, in which the wrapping material consists of cotton.

6. A method according to claim 1, in which the wrapping material consists of glass fibers.

7. A method according to claim 1, in which the wrapping material consists of wood cellulose fibers.

8. A method according to claim 1, in which the wrapping material consists of polymer fibers.

9. A method according to claim 1, in which the thickness of the insulating layer is at most 5 mm.

10. A method according to claim 1, in which the wrapping material is spirally-wound around the metallic surface.

11. A method of improving the breakdown resistance of a transformer oil in the vicinity of a metallic electrostatic shield in a power transformer of a converter plant of a high voltage direct current (HVDC) power transmission system, which method comprises applying at least three layers of ion-porous electrically insulating material around the shield, the insulating material having pores therein in the range from 0.2 to 10 $mm^2$ and with an aggregate pore area which is from 20 to 80% of the total area of the wrapping material.

12. A method as claimed in claim 11, in which there are from eight to thirty layers and the thickness of the applied layers is nowhere greater than 5 mm.

13. A method as claimed in claim 11, in which the thickness of the applied layers lies in the range 1 to 5 mm.

14. A method as claimed in claim 11, in which sufficient layers are applied around the shield so that the metallic material of the shield is no longer visible through the pores.

* * * * *